United States Patent [19]

Irie et al.

[11] 4,204,890

[45] May 27, 1980

[54] METHOD OF PRODUCING NON-ORIENTED SILICON STEEL SHEETS HAVING AN EXCELLENT ELECTROMAGNETIC PROPERTY

[75] Inventors: Toshio Irie, Chiba; Ko Matsumura, Ichihara; Hiroto Nakamura, Chiba; Hiroshi Shimanaka, Funabashi; Toshio Suzuki, Chiba, all of Japan

[73] Assignee: Kawasaki Steel Corporation, Kobe, Japan

[21] Appl. No.: 958,607

[22] Filed: Nov. 8, 1978

[30] Foreign Application Priority Data

Nov. 11, 1977 [JP] Japan ..... 52/134688

[51] Int. Cl.[2] ..... H01F 1/04

[52] U.S. Cl. ..... 148/111; 148/31.55

[58] Field of Search ..... 148/111, 110, 31.55

[56] References Cited

U.S. PATENT DOCUMENTS

| | | | |
|---|---|---|---|
| 3,239,388 | 3/1966 | Sasaki | 148/2 |
| 3,770,517 | 11/1973 | Gray et al. | 148/111 |
| 3,908,432 | 9/1975 | Ichiyama et al. | 148/111 |
| 3,932,234 | 1/1976 | Imanaka et al. | 148/112 |
| 3,933,537 | 1/1976 | Imanaka et al. | 148/112 |
| 3,940,299 | 2/1976 | Goto et al. | 148/111 |
| 3,960,616 | 6/1976 | Evans et al. | 148/111 |
| 3,971,678 | 7/1976 | Vlad | 148/111 |
| 4,046,602 | 9/1977 | Stanley | 148/111 |

FOREIGN PATENT DOCUMENTS

| | | |
|---|---|---|
| 12-800633 | 7/1937 | Japan . |
| 47-839079 | 10/1972 | Japan . |
| 49-76719 | 4/1974 | Japan . |
| 51-29496 | 8/1976 | Japan . |

*Primary Examiner*—R. Dean
*Assistant Examiner*—John P. Sheehan

[57] ABSTRACT

Non-oriented silicon steel sheets having an excellent electromagnetic property is obtained by annealing a hot rolled steel sheet containing not moe than 0.02% of C, 0.5–3.5% of Si, 0.1–1.0% of Al, 0.1–1.0% of Mn, not more than 0.007% of S and 0.005–0.30% of Sb at a temperature of 700°–950° C., cold rolling the annealed sheet, and annealing the cold rolled sheet at a temperature of 750°–1,000° C.

7 Claims, 6 Drawing Figures

METHOD OF PRODUCING NON-ORIENTED SILICON STEEL SHEETS HAVING AN EXCELLENT ELECTROMAGNETIC PROPERTY

BACKGROUND OF THE INVENTION (1) Field of the Invention

The present invention relates to a method of producing non-oriented silicon steel sheets having excellent electromagnetic properties.

(2) Description of the Prior Art

Non-oriented electrical steel sheets are used in the core of a generator, a motor, a small size transformer and the like. The electromagnetic properties demanded to the electrical steel sheets are high magnetic induction and low iron loss.

The core size of electric instruments is determined depending upon the magnetic induction of core. For example, when the magnetic induction of a steel sheet to be used in a core is higher by 10%, the thickness of the core can be decreased by about 10%. When the thickness of core is small, the amount of windings can be decreased and the sizes of shaft and case can be small, and electric instruments can be made into a smaller size as a whole. Recently, electrical steel sheets having a low iron loss are demanded for energy saving. However, non-oriented electrical steel sheets having a low iron loss are generally low in the magnetic induction, and therefore the steel sheets having a low iron loss are not widely used. For example, non-oriented electrical steel sheets of S-10 grade in the JIS is about ½ of that of S-23 grade in the JIS in the iron loss, but the magnetic induction of the former steel sheets is lower by 3–4 than that of the latter steel sheets. The reason is that, when Si and Al are added to steel in order to lower the iron loss of the resulting non-oriented silicon steel sheets by increasing the specific resistance thereof, the addition amounts of Si and Al must be larger in the production of the steel sheets having the lower iron loss.

The iron loss of non-oriented electrical steel sheets is occupied by the hystersis loss rather than by the eddy-current loss contrary to the iron loss of oriented electrical steel sheets, and the hystersis loss occupies generally 60–80% of the total iron loss. The hysteresis loss is in inverse proportion to the crystal grain size. It is an effective means to promote the normal grain growth of recrystallized grains at the final annealing in order to decrease the iron loss. It has been known that sulfide and nitride dispersed in silicon steel in the form of fine precipitates of less than 0.1 μm size prevent the grain growth in the steel and increase the iron loss of the resulting non-oriented silicon steel sheet.

Further, as another factor which influences the magnetic induction of steel sheet, aggregation texture thereof is known. However, methods of improving the magnetic induction of non-oriented silicon steel sheet by improving its aggregation texture has not substantially known. Non-oriented silicon steel sheet having a (100) plane parallel to the sheet surface, that is, having a texture of {100}[uvw] type, is ideal, and several production methods have been proposed. However, the production of the steel sheet is very expensive, and the steel sheet is not produced at all in a commercial scale.

SUMMARY OF THE INVENTION

The object of the present invention is to provide a method of producing non-oriented silicon steel sheets having an excellent electromagnetic property, which is superior to that of hitherto been known non-oriented silicon steel sheets.

That is, the feature of the present invention is the provision of a method of producing non-oriented silicon steel sheets having an excellent electromagnetic property, comprising annealing a hot rolled steel sheet consisting of not more than 0.02% of C, 0.5–3.5% of Si, 0.1–1.0% of Al, 0.1–1.0% of Mn, not more than 0.007% of S, 0.005–0.30% of Sb and the remainder being substantially Fe at a temperature of 700°–950° C. for 2 minutes–20 hours, cold rolling the annealed sheet into a final gauge, and annealing the cold rolled sheet at a temperature of 750°–1,000° C.

DETAILED DESCRIPTION OF THE INVENTION

The inventors have investigated minutely the influence of additives for non-oriented electrical steel upon its magnetic property, and found that, when a very small amount of Sb is added to a silicon steel having a low S content, the growth of crystal grains in the silicon steel is promoted, and further the intensity of the (111) plane of the final product is lowered, that is, the aggregation texture thereof is improved.

It has hitherto been known that Sb segregates in the grain boundary to prevent the boundary migration and hence the normal grain growth of recrystallized grains is prevented. There have been proposed several methods, wherein Sb is added to silicon steel in order to promote the development of secondary recrystallized grains in the (110) [001] direction of grain-oriented silicon steel by utilizing the above described effect. For example, in Japanese Pat. Nos. 412,621 and 839,079, in Japanese Patent Application Publication No. 29,496/76, and in Japanese Published Unexamined Patent Application No. 76,719/74, 0.005–0.5% of Sb is contained in silicon steel.

Japanese Pat. No. 800,633 discloses that, when Sb is added to a cold rolled rimmed steel sheet, the intensity of the (111 ) plane of the final product is high, and the deep drawing property thereof is improved. However, the (111) plane of α-iron does not contain (001) axis of easy magnetization axis, and therefore the fact that the intensity of the (111) plane of the final product is high means that the magnetic property of the product is poor. That is, Sb prevents the growth of crystal grains and affects adversely the aggregation texture. Therefore, non-oriented electrical steel sheet has hitherto been produced without the addition of Sb as far as possible, except the case where a small amount of Sb is added to silicon steel in order to prevent the nitriding, and it has never been thought of to add Sb to silicon steel in order to improve the magnetic property of the final product.

The inventors have found that, in a silicon steel sheet containing a very small amount of S, the above described effects of Sb for suppressing the grain growth and for increasing the intensity of the (111) plane do not appear but Sb has an effect for lowering the intensity of the (111) plane, and this effect is effectively improved by a proper annealing. As the result, the present invention has been accomplished.

The effect of Sb for improving the aggregation texture will be explained hereinafter with reference to experimental data.

Figure 1A:
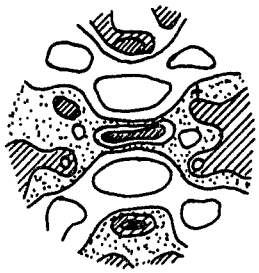
FIGS. 1*a*, 1*b* and 1*c* are (200) pole figures of the final products.
Figure 1B:
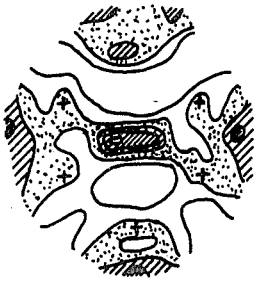
Figure 1C:
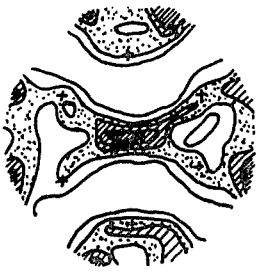

A steel ingot containing 1.86% of Si, 0.24% of Mn, 0.32% of Al, 0.006% of S, 0.015% of C and a variant amount (0%, 0.008% and 0.088%) of Sb was hot rolled. The hot rolled steel sheet was annealed at 800° C. for 5 hours under nitrogen atmosphere, pickled and then cold rolled into a final gauge of 0.5 mm, and the cold rolled sheet was annealed at 840° C. for 1 hour under nitrogen atmosphere. FIGS. 1*a*, 1*b* and 1*c* show the (200) pole figures of the final products. It can be seen from the pole figures that, in the comparative steel sheet containing no Sb (refer to FIG. 1*a*), {111}<112>, which is not so important for the property of steel sheet, is the main component. On the contrary, in the steel sheet containing 0.008% of Sb (refer to FIG. 1*b*), the intensity of the {111}plane is low, and further in the steel sheet containing 0.088% of Sb (refer to FIG. 1*c*), the intensity of (100)[uvw], which is favorable for the property of the steel sheet, is very high.

The influence of Sb content in the hot rolled steel sheet upon the electromagnetic property of the final product will be explained hereinafter.

Figure 2:
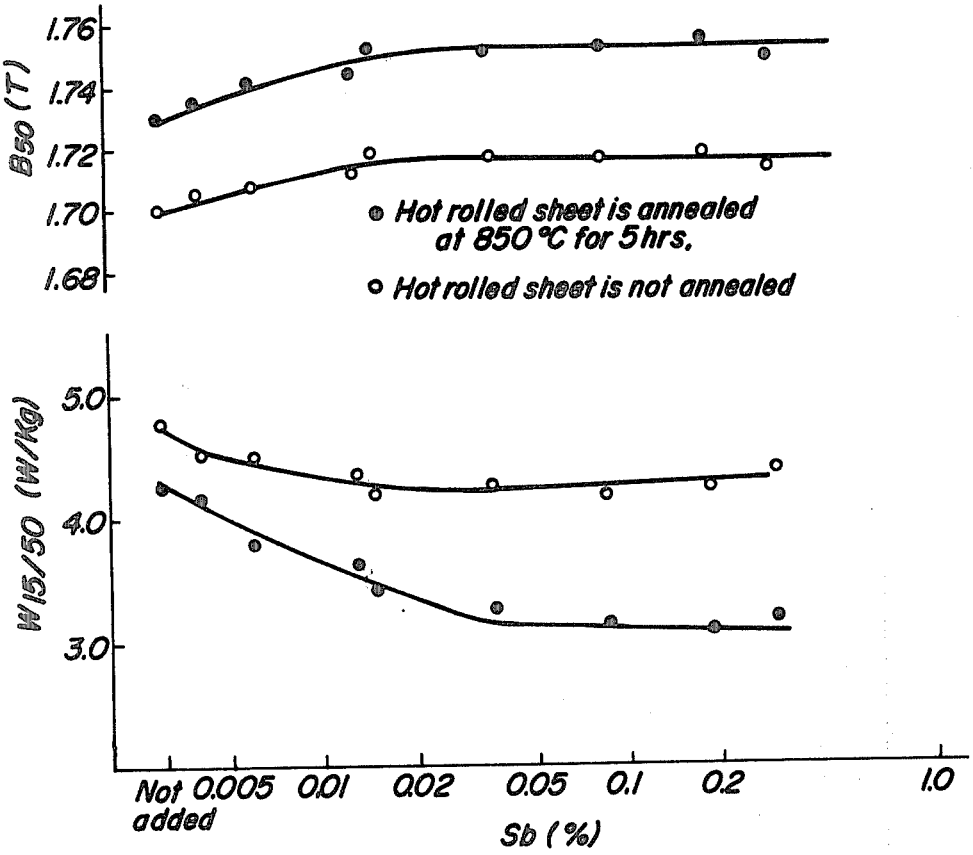
FIGS. 2 and 3 are graphs illustrating the relation between the Sb content in the hot rolled sheet and the $B_{50}$ (Tesla) or $W_{15/50}$ (W/kg) of the final product.
Figure 3:
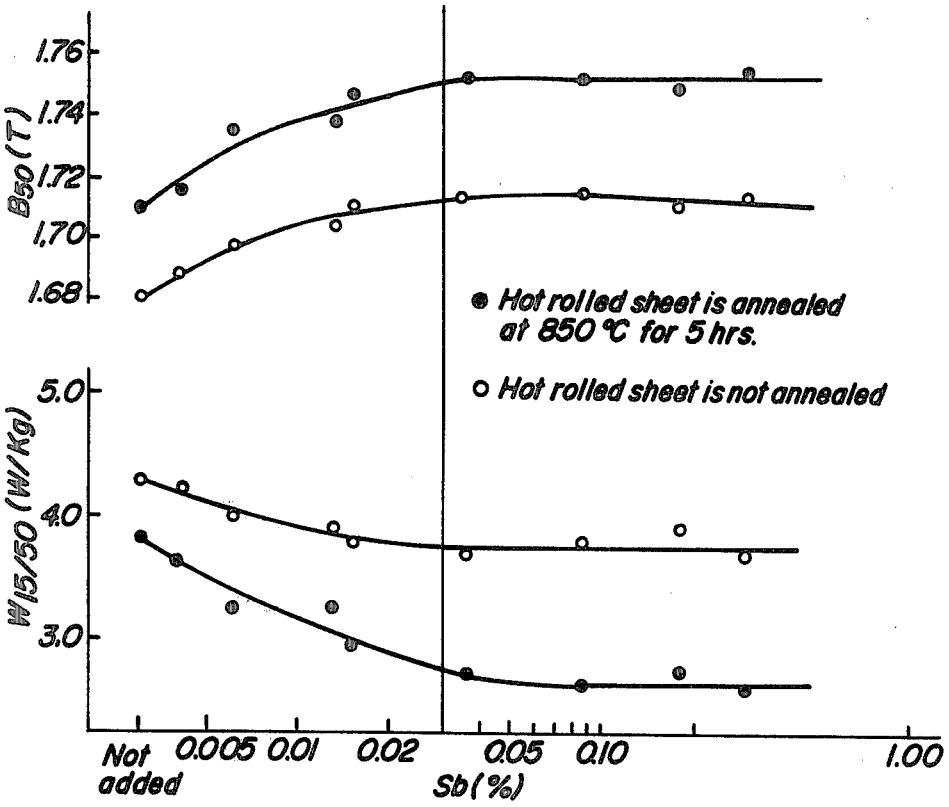

A hot rolled steel sheet containing 0.005–0.008% of C, 1.81–1.88% of Si, 0.30–0.33% of Mn, 0.28–0.35% of Al, 0.04–0.06% of S and a variant amount of Sb was annealed at 850° C. for 5 hours under nitrogen atmosphere, and cold rolled into a final gauge of 0.50 mm. The cold rolled sheet was annealed at 900° C. for 5 minutes under an AX gas atmosphere having a dew point of 50° C., and an Epstein test piece was cut out from the sheet. The magnetic properties of the test piece was measured. FIG. 2 shows the result. Further, the same hot rolled sheet as described above was directly cold rolled without annealing, and an Epstein test piece was cut out from the cold rolled sheet before the sheet was annealed. The test piece was annealed at 840° C. for 1 hour under a DX gas atmosphere having a dew point of 30° C., and the magnetic property of the test piece was measured. FIG. 3 shows the result. It can be seen from FIGS. 2 and 3 that, when the addition amount of Sb is increased, the magnetic induction is increased and the iron loss is decreased, and this tendency is remarkably noticeable when a hot rolled sheet is annealed before cold rolling. Sb is effective for improving the property of the final product in an addition amount of at least 0.005%, and is particularly effective in an addition amount of at least 0.03%. When the amount of Sb exceeds 0.4%, the steel sheet is apt to crack at the cold rolling.

Figure 4:
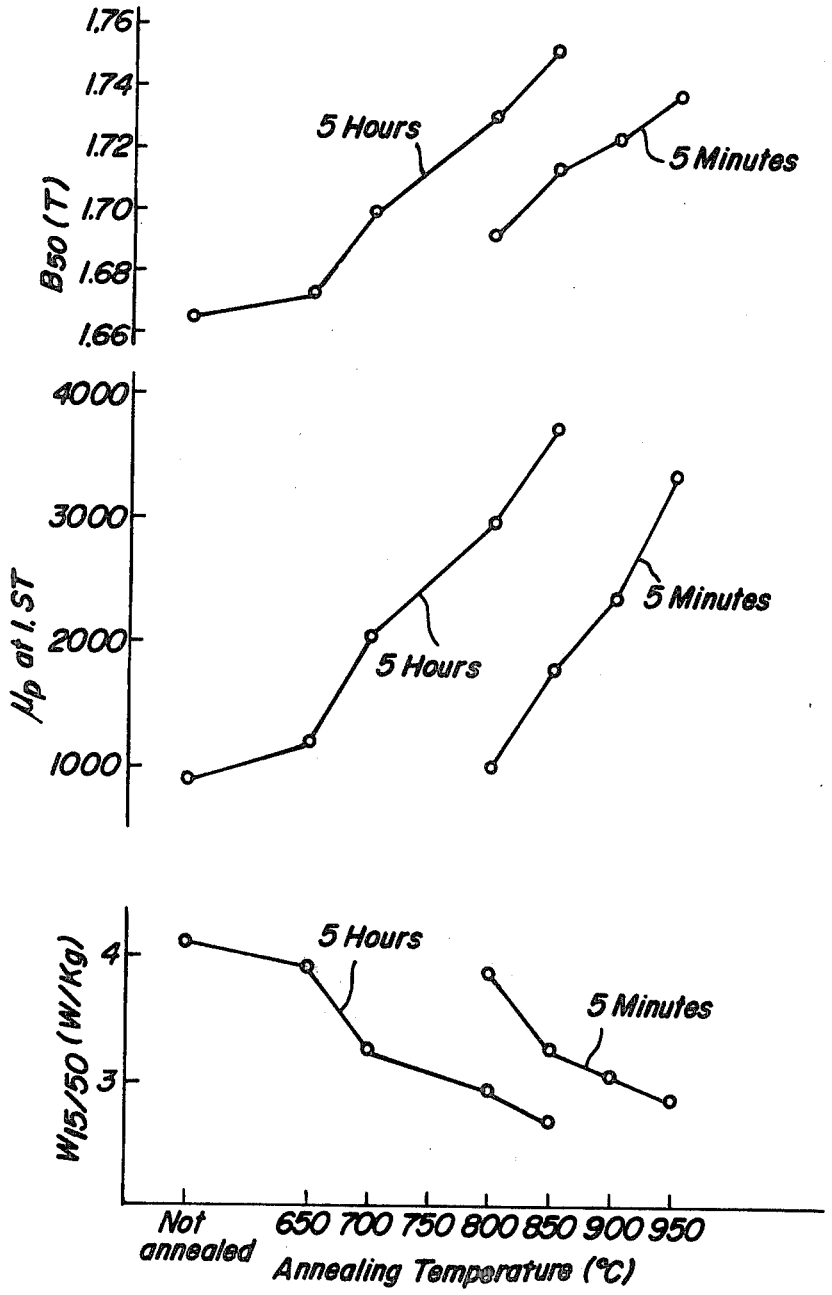
FIG. 4 is a graph illustrating the influences of annealing temperature and annealing time of a hot rolled sheet containing 0.036% of Sb upon the magnetic properties of the final product.

Among the hot rolled sheets used in the experiments shown in FIGS. 2 and 3, the hot rolled sheet containing 0.036% of Sb was annealed at 650°–850° C. for 5 hours or at 800°–950° C. for 5 minutes and then cold rolled into a final gauge of 0.50 mm. An Epstein test piece was cut out from the cold rolled sheet, and the test piece was annealed at 840° C. for 1 hour under a DX gas atmosphere having a dew point of 27° C., which consisted of 12% of $H_2$, 9% of CO, 5.5% of $CO_2$ and the remainder being $H_2$. The magnetic property of the above treated steel sheet is shown in FIG. 4. It can be seen from FIG. 4 that not less than 700° C. of annealing temperature of hot rolled sheet is effective for improving the property of final product, and when the annealing temperature is not less than 850° C., a final product having an excellent property can be obtained in a very short period of time of only 5 minutes. However, when the annealing temperature is higher than 950° C., the steel sheet is apt to crack at the cold rolling. Therefore, the annealing temperature must be not higher than 950° C.

In the present invention, the composition of the starting hot rolled silicon steel sheet must be limited to the above defined range based on the following reason.

Si is added to steel sheet in order to increase its specific resistivity and to decrease its eddy-current loss. However, hot rolled sheet containing more than 3.5% of Si is difficult to be cold rolled. While, in the lower grade silicon steel sheet containing less than 0.5% of Si, a final product having the property satisfying the grade can be easily obtained without using the technic of the present invention. Therefore, the Si content in the hot rolled sheet must be within the range of 0.5–3.5%. Particularly, when the hot rolled sheet contains 1.0–3.0% of Si, a good result is obtained.

When the Al content in the hot rolled sheet is lower than 0.1%, AlN precipitates finely in the cold rolled and often suppresses the grain growth by the coexistence of Sb. While, when the Al content in the hot rolled sheet exceeds 1.0%, the sheet is difficult to be cold rolled. Therefore, the Al content in the hot rolled sheet must be within the range of 0.1–1.0%.

C is harmful for the property of the final product. When more than 0.02% of C is contained in the hot rolled sheet, even if the hot rolled sheet is annealed, the steel is difficult to be decarburized to a given level of C. Therefore, the C content in the hot rolled sheet must be not more than 0.02%.

S is an undesirable element for the property of the final product. When S content in the hot rolled sheet exceeds 0.008%, the S prevent the normal grain growth of recrystallized grain in the sheet by the coexistence of Sb. Therefore, the S content in the hot rolled sheet must be not more than 0.007%, and is preferably not more than 0.005%.

Sb must be contained in the hot rolled sheet in an amount of at least 0.005% in order to improve the aggregation texture of the final product. However, even when the Sb content in the hot rolled sheet exceeds 0.3%, the aggregation texture of the final product does not appreciably improve, and further the cold rolling of the hot rolled sheet is difficult. Therefore, the Sb content in the hot rolled sheet must be within the range of 0.005–0.3%. Particularly, when the Sb content is 0.015–0.15%, a good result is obtained.

Rare earth metals or calcium are effective for promoting the normal grain growth at the final annealing and for decreasing the iron loss of the final product. When the hot rolled sheet further contains 0.005–0.04% of rare earth metals or 0.001–0.01% of Ca, the normal grain growth is more promoted at the final annealing and the final product having a lower iron loss can be obtained.

The starting material to be used in the present invention is a hot rolled silicon steel sheet having the above described composition, and can be produced by a commonly known technic. For example, a silicon steel is melted in an open hearth, converter, electric furnace or vacuum furnace, and the molten steel may be made into an ingot and then slabbed, or may be directly formed into a slab by the continuous casting. The resulting slab is hot rolled by the conventional hot rolling technic. The thickness of the hot rolled sheet is generally 1.5–3 mm. It is important in the present invention that the hot rolled sheet is annealed at a temperature of 700°–950° C. for a proper period of time before the cold rolling. As seen from FIG. 2, when this annealing is omitted, the influence of Sb upon the improvement of the properties of the final product is low. The annealing time can be properly determined depending upon the annealing temperature. For example, when the annealing is carried out at a relatively low temperature of 700° C., a long period of time of at least 10 hours is required in the annealing, while when the annealing is carried out at a high temperature of 950° C., the object of the annealing can be attained by a short period of time of about 3 minutes. When the annealing temperature is lower than 700° C., even if the annealing is carried out for a long period of time of 10–20 hours, the annealing is not effective. While, even when the annealing temperature exceeds 950° C., the property of the final product is not so improved, and moreover the cold rolling of the annealed sheet is difficult. Therefore, the annealing temperature of the hot rolled sheet must be within the range of 700°–950° C.

The annealing atmosphere may be nitrogen, DX gas, AX gas, hydrogen and air, and is not particularly limited. Further, the annealing method may be tight annealing, open annealing or continuous annealing. The annealed sheet is pickled and then cold rolled by a conventional technic. The cold rolling can be carried out by means of any of tandem mill, reverse mill and Sendzimmer mill. Further, the cold rolling can be carried out by the one-stage cold rolling or the two-stage cold rolling with an intermediate annealing. Particularly, the present invention is effective in the case where the one-stage cold rolling is carried out. The cold rolled sheet is subjected to a final annealing at a temperature of 750°–1,000° C. to obtain the final product, non-oriented silicon steel sheet, having an excellent electromagnetic property.

The present invention can be applied to the production of full-processed product and to the production of semi-processed product. In the former case, the final annealing is carried out by the electrical steel sheet manufacture to produce the final product. In this final annealing, a continuous annealing of the cold rolled sheet is advantageously carried out at a relatively high temperature of 850°–1,000° C. for a short period of not longer than 15 minutes, and is most preferably carried out at a temperature of 850°–950° C. for 2–8 minutes. While, in the latter case, the final annealing is carried out by the electric apparatus manufacturer. That is, the electrical steel sheet manufacturer carries out a continuous annealing of the cold rolled sheet at a temperature of 750°–850° C. for 10 seconds to 3 minutes in order to correct the shape and the like of the sheet to produce an intermediate product, that is, semiprocessed product. The electric apparatus manufacturer punches the intermediate product into a desired shape to be used for an electric apparatus, and then carries out a final annealing of the intermediate product at a temperature of 750°–900° C. for 0.5–3 hours to produce a final product having a desired property.

The following examples are given for the purpose of illustration of this invention and are not intended as limitations thereof.

EXAMPLE 1

A hot rolled sheet having a thickness of 2 mm and a composition shown in the following Table 1, the remainder being substantially Fe, was annealed and then subjected to a one-stage cold rolling to produce a coil having a final gauge of 0.5 mm, and the cold rolled coil was annealed at 900° C. for 5 minutes under an AX gas atmosphere having a dew point of 40° C. An Epstein test piece was cut out from the coil, and the electromagnetic property of the test piece was measured. The obtained results are shown in Table 1.

Table 1

| | C (%) | Si (%) | Al (%) | Mn (%) | S (%) | Sb (%) | Annealing of hot rolled sheet | $W_{15/50}$ (W/kg) | $B_{50}$ (T) |
|---|---|---|---|---|---|---|---|---|---|
| Example | 0.006 | 3.02 | 0.41 | 0.16 | 0.003 | 0.018 | at 850° C. for 5 hrs. in $N_2$ | 2.61 | 1.71 |
| Comparative example | 0.007 | " | " | " | " | " | not annealed | 2.89 | 1.67 |
| Comparative example | 0.006 | 3.01 | 0.39 | 0.14 | " | tr. | at 850° C. for 5 hrs. | 2.80 | 1.68 |

$W_{15/50}$: watt loss at 50Hz and 1.5T
$B_{50}$: magnetic induction at 5000A/m

EXAMPLE 2

A hot rolled steel sheet containing 0.008% of C, 1.86% of Si, 0.21% of Mn, 0.005% of S, 0.35% Al and 0.09% of Sb was annealed at 600–900° C. for 5 hours and then subjected to a one-stage cold rolling to produce a coil having a final gauge of 0.5 mm. The cold rolled coil was annealed at 900° C. for 5 minutes under an AX gas atmosphere having a dew point of 50° C. An Epstein test piece was cut out from the annealed coil, and the electromagnetic property of the test piece was measured. Further, an Epstein test piece was cut out from the cold rolled coil before the coil was annealed, and the test piece was annealed at 840° C. for 1 hour under a DX gas atmosphere having a dew point of 30° C., and the electromagnetic property of the test piece was measured. The obtained results are shown in Table 2.

Table 2

| | Annealing temperature of hot rolled sheet (°C.) | After a cold rolled coil is annealed at 900° C. for 5 min., an Epstein test piece is cut out from the coil | | An Epstein test piece is directly cut out from a cold rolled coil, and the test piece is annealed at 840° C. for 1 hr. | | |
|---|---|---|---|---|---|---|
| | | $W_{15/50}$ (W/kg) | $B_{50}$ (T) | $W_{15/50}$ (W/kg) | $B_{50}$ (T) | μp at 1.5T |
| Comparative example | 600 | 4.27 | 1.69 | 3.82 | 1.70 | 840 |
| Comparative example | 650 | 3.99 | 1.70 | 3.49 | 1.70 | 1,420 |
| Example | 700 | 3.52 | 1.71 | 3.40 | 1.71 | 2,470 |
| Example | 800 | 3.21 | 1.73 | 2.80 | 1.73 | 3,430 |
| Example | 900 | 2.95 | 1.74 | 2.75 | 1.75 | 3,720 |

EXAMPLE 3

Each of a hot rolled steel sheet having a thickness of 2 mm and containing 1.10% of Si, 0.22% of Al, 0.21% of Mn, 0.004% of S and 0.04% of Sb, and a hot rolled steel sheet having a thickness of 2 mm and containing 1.15% of Si, 0.24% of Al, 0.23% of Mn, 0.004% of S and no Sb, was annealed at 800° C. for 5 hours and then subjected to a one-stage cold rolling to produce a coil having a final gauge of 0.64 mm. The cold rolled coil was incompletely annealed at 760° C. for 1.5 minutes under nitrogen atmosphere. An Epstein test piece was cut out from the incompletely annealed coil, and the test piece was further annealed at 840° C. for 1 hour under a DX gas atmosphere having a dew point of 27° C. The following Table 3 shows the property of the above treated test pieces.

Table 3

| | | $W_{15/50}$ (W/kg) | $B_{50}$ (T) | μp at 1.5T |
|---|---|---|---|---|
| Example | Sb : 0.04% | 2.69 | 1.74 | 3,680 |
| Comparative example | Sb : tr. | 2.82 | 1.71 | 1,930 |

As described above, according to the present invention, non-oriented silicon steel sheets having an excellent electromagnetic property can be produced.

What is claimed is:

1. A method of producing non-oriented silicon steel sheets having excellent electromagnetic properties, comprising annealing a hot rolled sheet consisting of not more than 0.02% of C, 0.5–3.5% of Si, 0.1–1.0% of Al, 0.1–1.0% of Mn, not more than 0.007% of S, 0.005–0.30% of Sb and the remainder being substantially Fe at a temperature of 700°–950° C. for 2 minutes to 20 hours, cold rolling the annealed sheet into a final gauge, and annealing the cold rolled sheet at a temperature of 750°–1,000° C.

2. A method according to claim 1, wherein the hot rolled sheet is subjected to a box annealing at a temperature of 700°–850° C. for 1–10 hours.

3. A method according to claim 1, wherein the hot rolled sheet is continuously annealed at a temperature of 850°–950° C. for 2–10 minutes.

4. A method according to claim 1, wherein the hot rolled sheet consists of 1.0–3.0% of Si, 0.03–0.3% of Sb, not more than 0.005% of S and the remainder being substantially Fe.

5. A method according to claim 1, wherein the hot rolled sheet further contains 0.005–0.04% of rare earth metals or 0.001–0.01% of Ca.

6. A method according to claim 1, wherein the cold rolled sheet is subjected to a continuous annealing at a temperature of 850°–950° C. for 2–8 minutes to produce a full-processed product.

7. A method according to claim 1, wherein the cold rolled sheet is subjected to a continuous annealing at a temperature of 750°–850° C. for 10 seconds to 3 minutes to produce an intermediate product, and the intermediate product is further subjected to an annealing at a temperature of 750°–900° C. for 0.5–3 hours.

* * * * *